US010446984B2

(12) United States Patent
Zhong et al.

(10) Patent No.: US 10,446,984 B2
(45) Date of Patent: Oct. 15, 2019

(54) ELECTRICAL CONNECTOR WITH TRANSVERSE LINKAGE BEHIND NEIGHBORING MATING TONGUES

(71) Applicant: FOXCONN INTERCONNECT TECHNOLOGY LIMITED, Grand Cayman (KY)

(72) Inventors: Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/101,802

(22) Filed: Aug. 13, 2018

(65) Prior Publication Data

US 2019/0052023 A1 Feb. 14, 2019

(30) Foreign Application Priority Data

Aug. 11, 2017 (CN) ..... 2017 1 0684276

(51) Int. Cl.

| | |
|---|---|
| ***H01R 13/405*** | (2006.01) |
| ***H01R 13/6582*** | (2011.01) |
| ***H01R 13/514*** | (2006.01) |
| ***H01R 13/6591*** | (2011.01) |
| ***H01R 24/62*** | (2011.01) |
| ***H01R 43/24*** | (2006.01) |
| ***H01R 13/504*** | (2006.01) |

(Continued)

(52) U.S. Cl.

CPC ..... *H01R 13/6582* (2013.01); *H01R 13/405* (2013.01); *H01R 13/504* (2013.01); *H01R 13/514* (2013.01); *H01R 13/6591* (2013.01); *H01R 24/62* (2013.01); *H01R 43/24* (2013.01); *H01R 13/6585* (2013.01); *H01R 24/60* (2013.01); *H01R 2107/00* (2013.01)

(58) Field of Classification Search

CPC ..... H01R 12/00; H01R 13/405
USPC ..... 439/736, 607.09
See application file for complete search history.

(56) References Cited

U.S. PATENT DOCUMENTS

| | | | | |
|---|---|---|---|---|
| 8,968,031 | B2 * | 3/2015 | Simmel | H01R 13/659 439/660 |
| 10,027,063 | B2 * | 7/2018 | Peng | H01R 12/594 |

(Continued)

FOREIGN PATENT DOCUMENTS

| | | |
|---|---|---|
| CN | 206004086 U | 3/2017 |
| TW | M461912 U | 9/2013 |

*Primary Examiner* — Phuong K Dinh

(74) *Attorney, Agent, or Firm* — Wei Te Chung; Ming Chieh Chang

(57) ABSTRACT

An electrical connector includes an insulative housing and a plurality of contacts embedded within the housing. The housing includes a base and at least two mating tongues extending forwardly from the base in a same front-to-back direction and spaced from each other in a transverse direction perpendicular to the front-to-back direction. Each mating tongue includes two mating surfaces. The housing includes an inner insulator which is integrally formed with the contacts via an insert-molding process, and an outer insulator which is further applied upon the inner insulator via another/successive insert-molding process. The inner insulator includes the two inner mating tongues and the bridge therebetween, and the outer insulator covers all the two inner mating tongues and the bridge.

8 Claims, 8 Drawing Sheets

(51) Int. Cl.

| | |
|---|---|
| *H01R 107/00* | (2006.01) |
| *H01R 13/6585* | (2011.01) |
| *H01R 24/60* | (2011.01) |

(56) References Cited

U.S. PATENT DOCUMENTS

| | | | | |
|---|---|---|---|---|
| 10,218,134 | B2 * | 2/2019 | Tsai | H01R 13/6585 |
| 10,236,610 | B2 * | 3/2019 | Lin | H01R 12/721 |
| 10,263,365 | B2 * | 4/2019 | Kato | H01R 27/02 |

* cited by examiner

ELECTRICAL CONNECTOR WITH TRANSVERSE LINKAGE BEHIND NEIGHBORING MATING TONGUES

BACKGROUND OF THE INVENTION

1. Field of the Invention

The invention relates to the electrical connector, particularly to the electrical connector providing a plurality of horizontally extending mating tongues spaced from one another along a transverse direction in a symmetrical manner with regard to a vertical center line of the whole connector set wherein every adjacent two mating tongues communicatively exposed to each other in the transverse direction while being equipped with a linkage connecting corresponding root sections behind the mating tongues.

2. Description of Related Art

An electrical connector having a plurality of different mating tongues communicatively spaced from each other in the transverse direction, may require to make different contact modules specifically and separately, thus increasing manufacturing cost.

It is desired to have an electrical connector with mating tongues to be made via the successive molding processes to integrate those mating tongues in both the transverse direction and the vertical direction and further the outer metallic shield.

SUMMARY OF THE INVENTION

An electrical connector includes an insulative housing and a plurality of contacts embedded within the housing. The housing includes a base and at least two mating tongues extending forwardly from the base in a same front-to-back direction and spaced from each other in a transverse direction perpendicular to the front-to-back direction. Each mating tongue includes two mating surfaces. The housing includes an inner insulator which is integrally formed with the contacts via an insert-molding process, and an outer insulator which is further applied upon the inner insulator via another/successive insert-molding process. The inner insulator includes the two inner mating tongues and the bridge therebetween, and the outer insulator covers all the two inner mating tongues and the bridge.

A method of making an electrical connector including the following steps: (1) providing two symmetrical inner insulator each integrally formed with the contacts via a first stage insert-molding process wherein each inner insulator includes two inner mating tongues spaced from each other with a bridge therebetween; (2) intimately sandwiching a metallic shielding plate between the two insulators and further sandwiching the two insulators between two metallic shields; (3) applying the outer insulators upon both the inner insulator and the metallic shields to finalize the corresponding mating tongues and cover the bridge via a second stage insert-molding process; and (4) optionally applying an insulative outer cover upon the outer insulator and the metallic shields to finalize the whole connector set.

Other objects, advantages and novel features of the invention will become more apparent from the following detailed description when taken in conjunction with the accompanying drawings.

DETAILED DESCRIPTION OF THE PREFERRED EMBODIMENT

Figure 1:
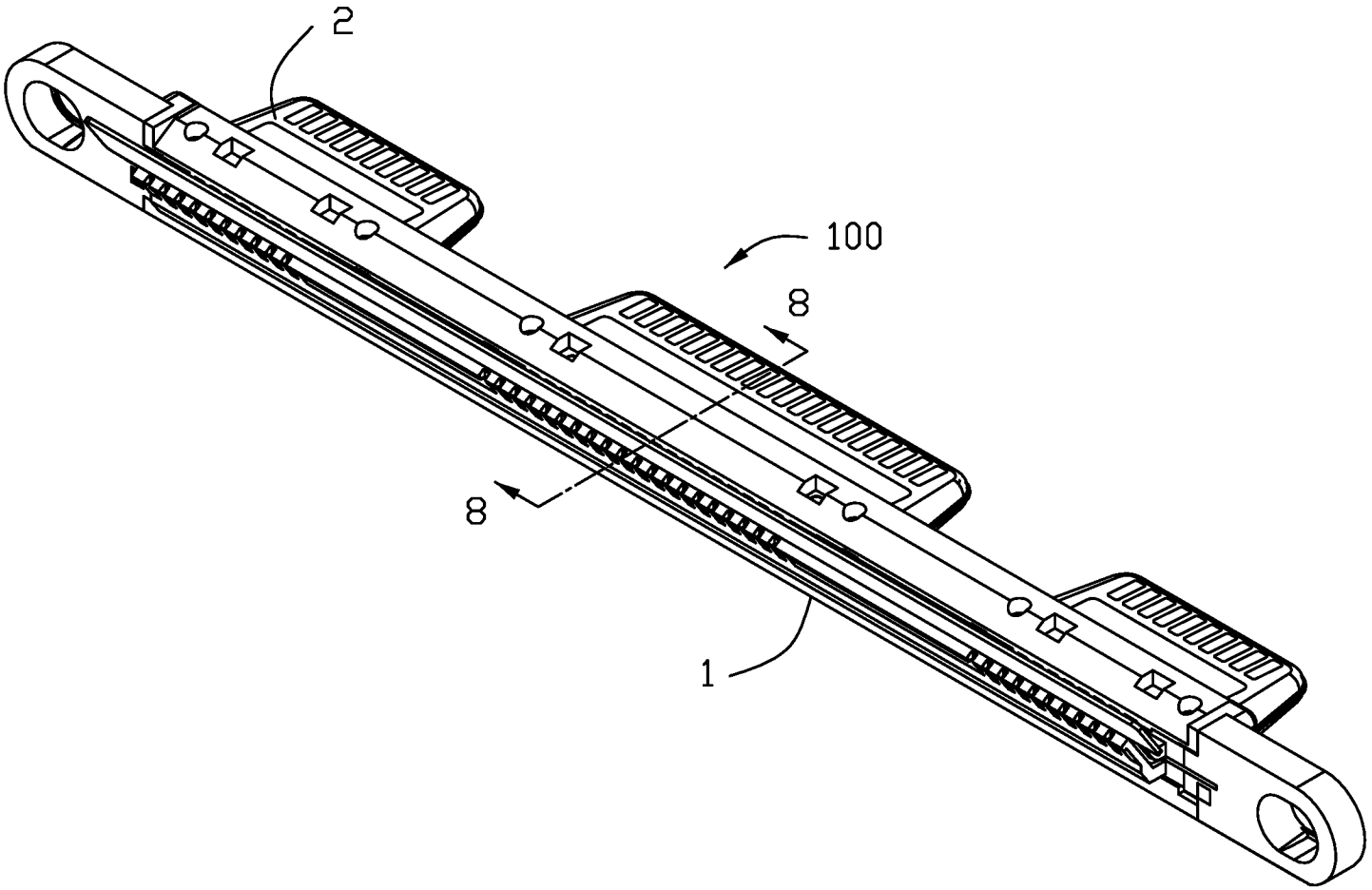
FIG. 1 is a rear downward perspective view of an electrical connector according to the invention.
Figure 2:
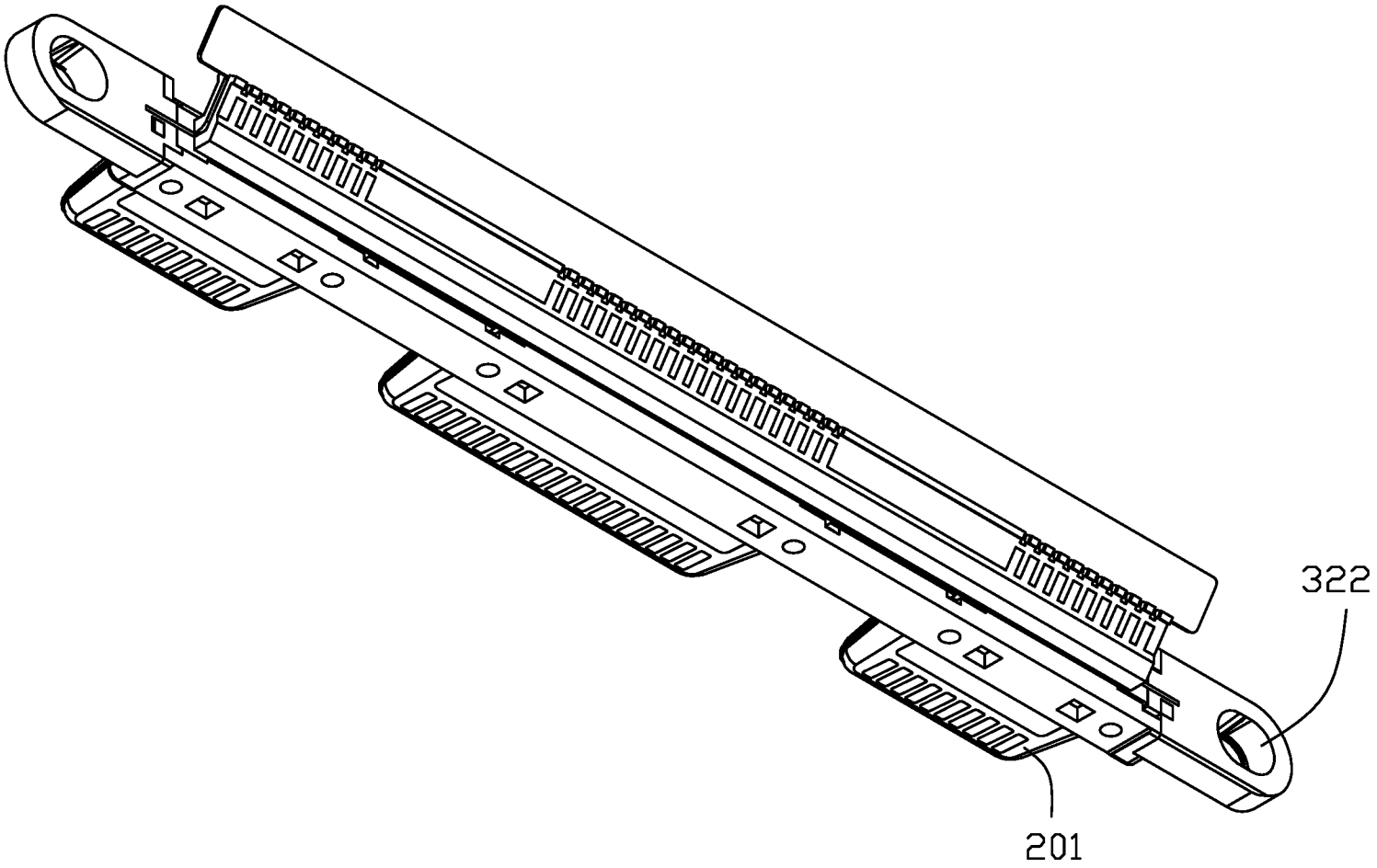
FIG. 2 is a rear upward perspective view of the electrical connector of FIG. 1.
Figure 3:
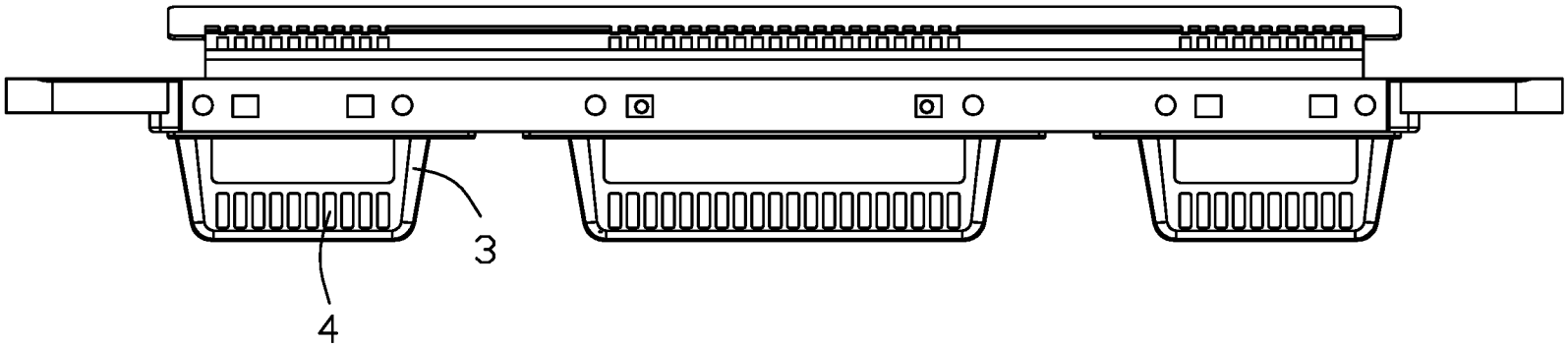
FIG. 3 is a top view of the electrical connector of FIG. 1.
Figure 4:
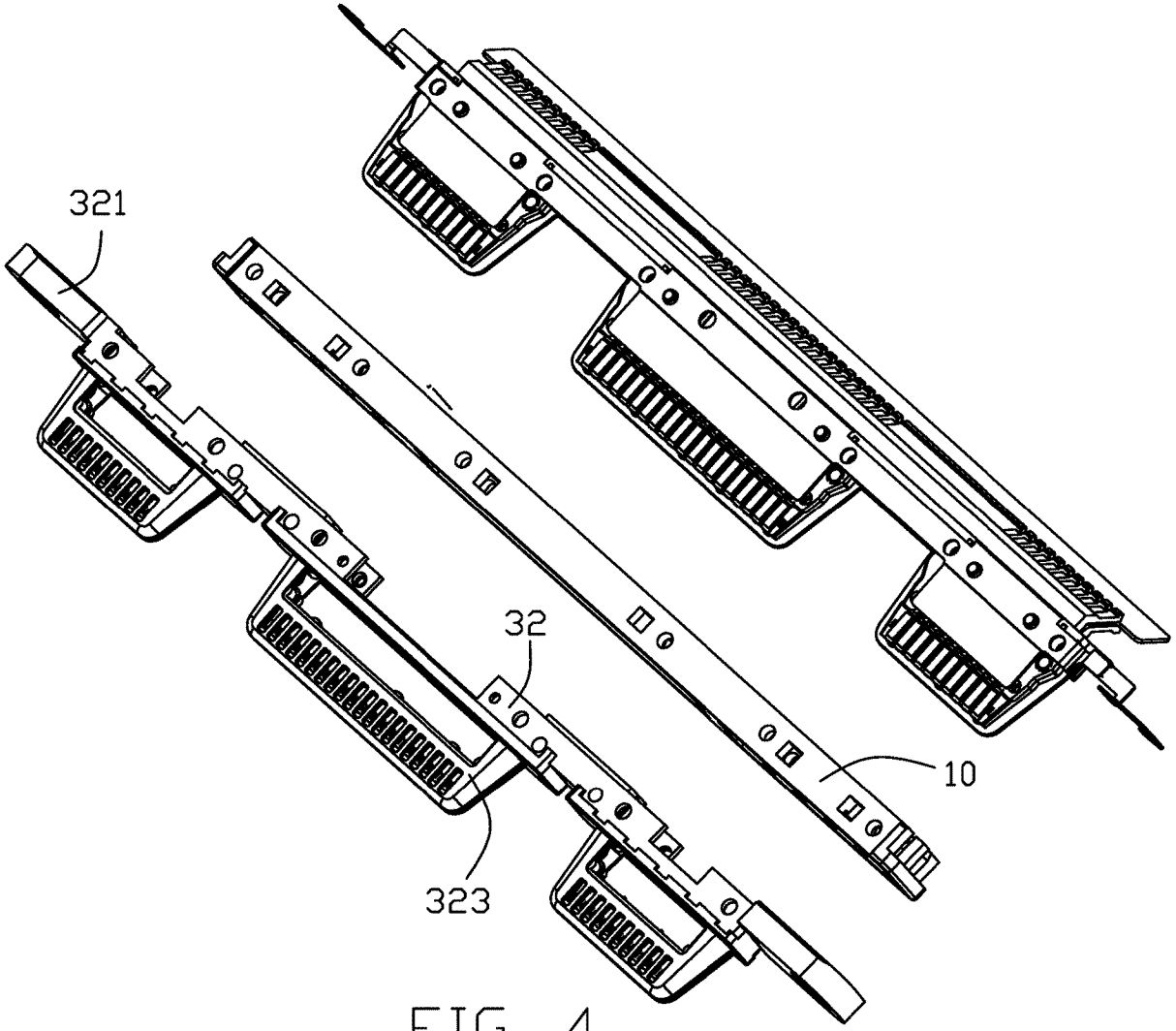
FIG. 4 is an upward exploded perspective view of the electrical connector of FIG. 1.
Figure 5:
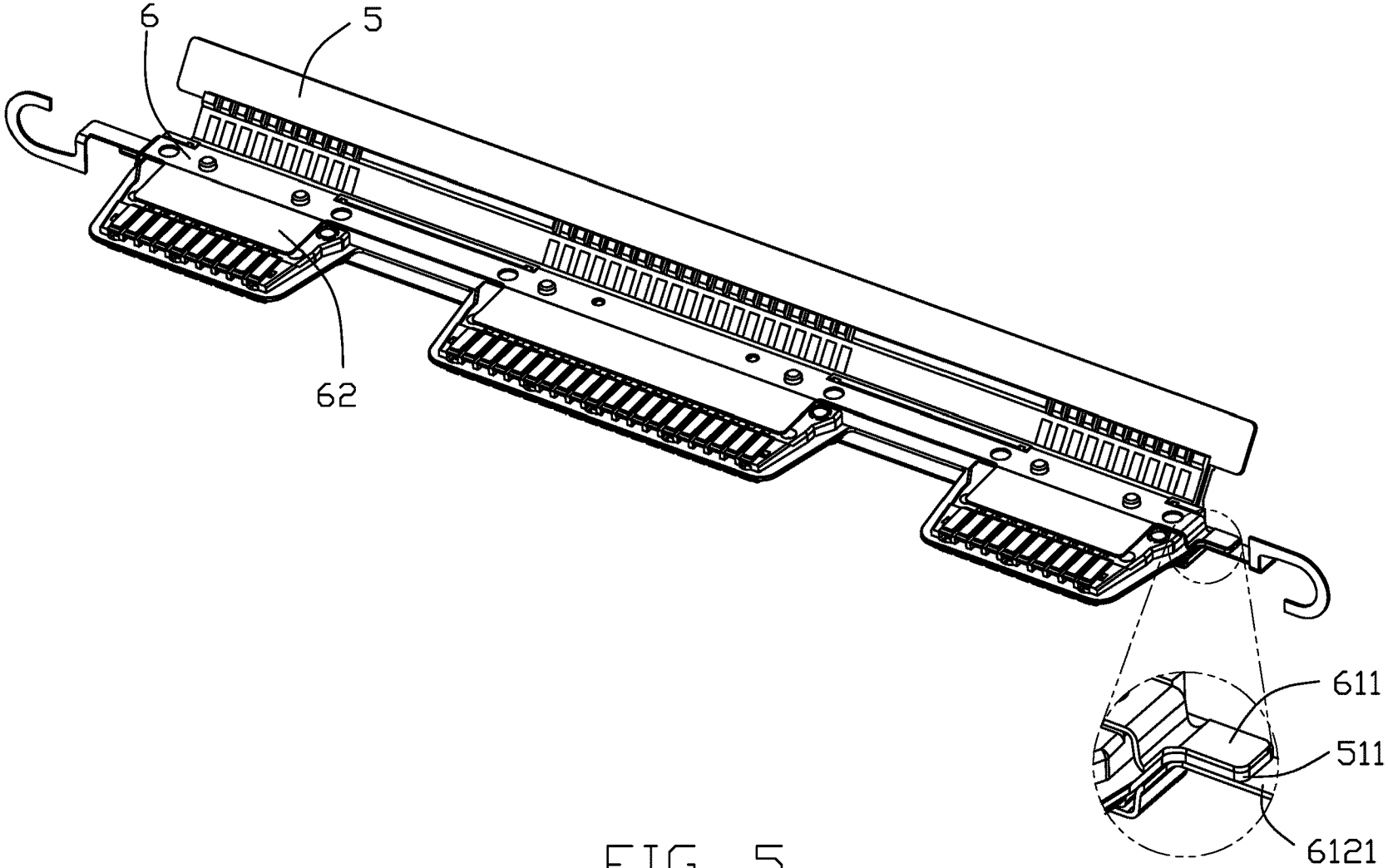
FIG. 5 is a front downward perspective view of the inner insulator with the corresponding contacts and the metallic shielding plate and the metallic shields associated therewith of the electrical connector of FIG. 1.
Figure 6:
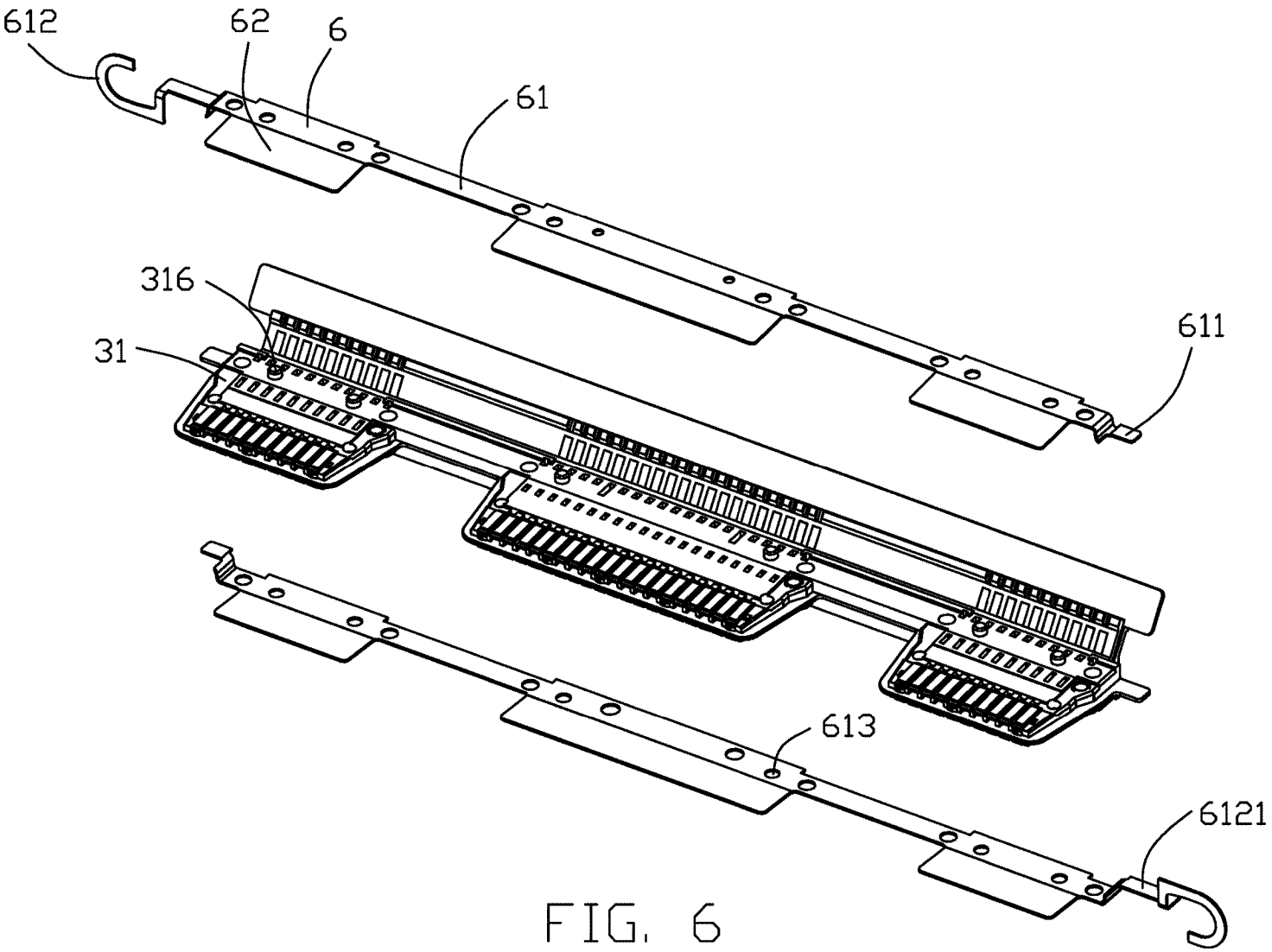
FIG. 6 is a front downward exploded perspective view of the inner insulator with the corresponding contacts and the metallic shielding plate and the metallic shields associated therewith of the electrical connector of FIG. 5.
Figure 7:
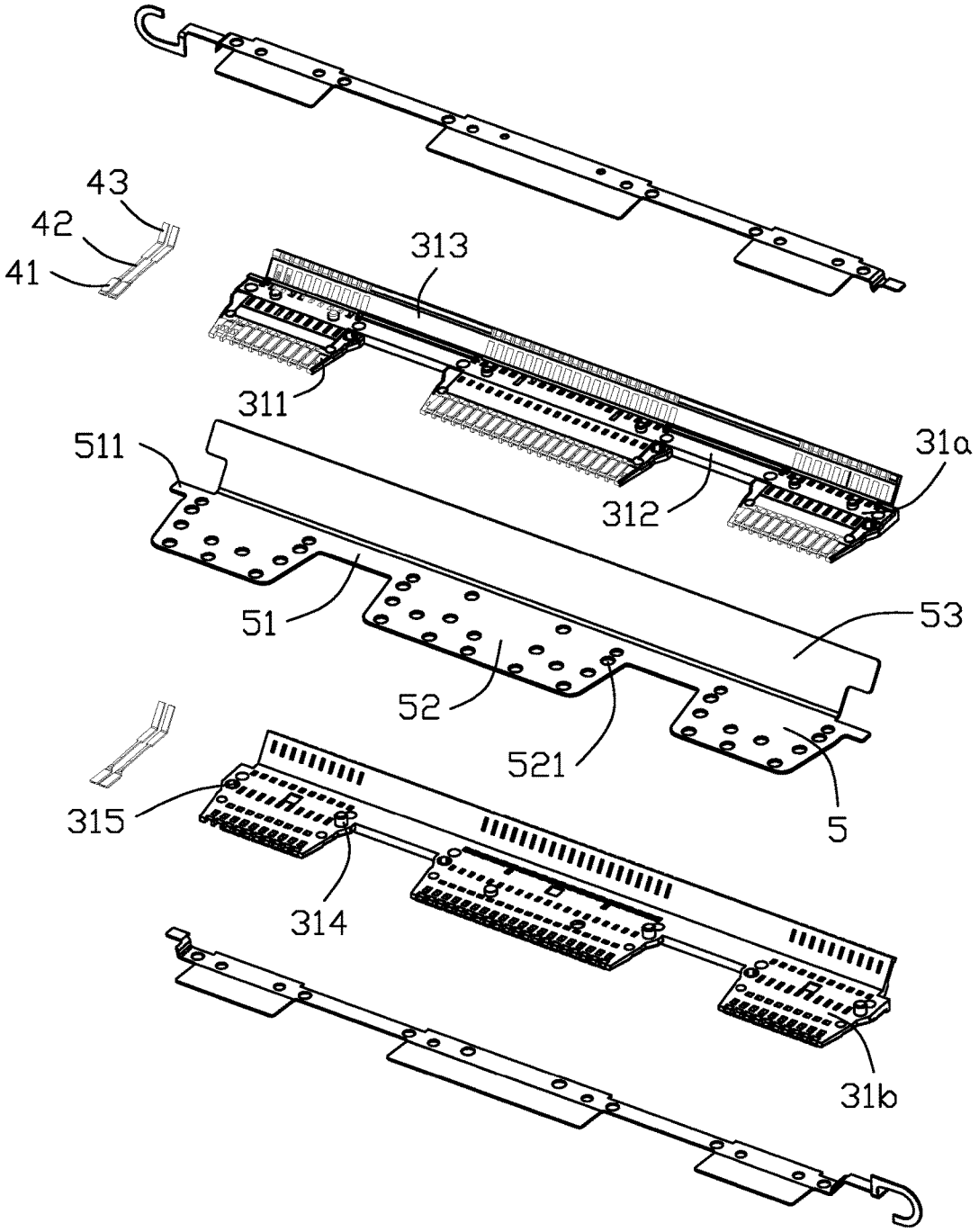
FIG. 7 is a front downward further exploded perspective view of the inner insulator with the corresponding contacts and the metallic shielding plate and the metallic shields associated therewith of the electrical connector of FIG. 1.
Figure 8:
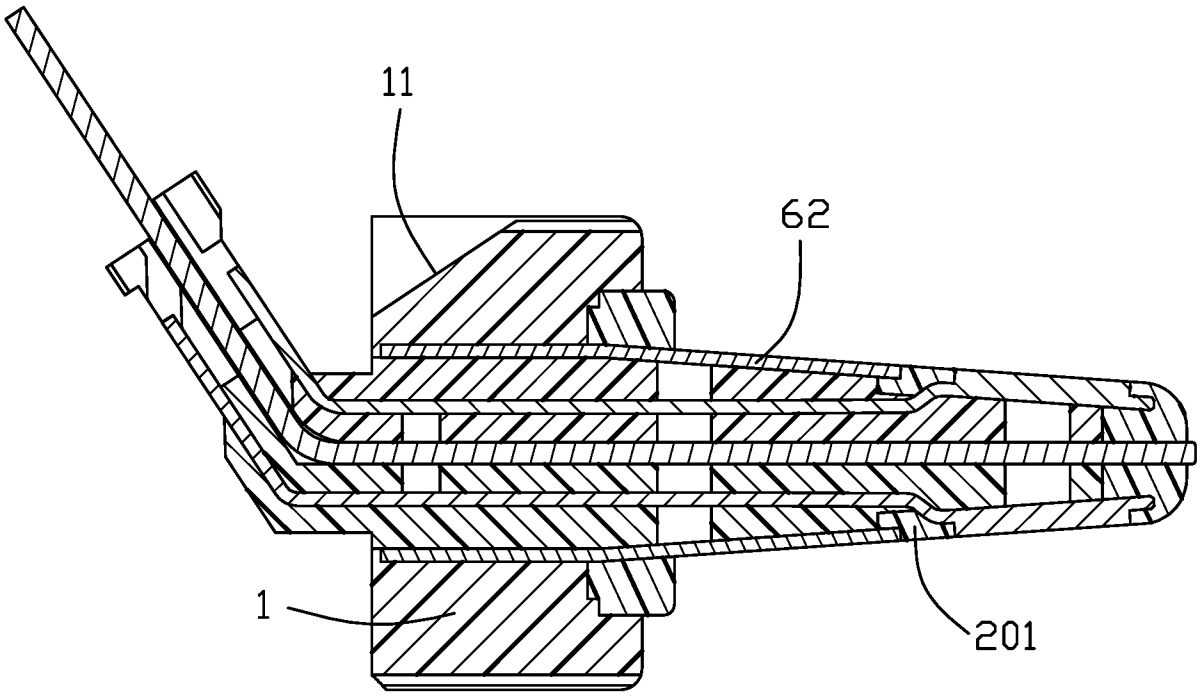
FIG. 8 is a cross-sectional view of the electrical connector of FIG. 1.

Referring to FIGS. 1-8, an electrical connector 100 includes an insulative housing 3 and a plurality of contacts 4 embedded within the housing 3. The housing 3 includes a base 1, and three mating tongues 2 extending forwardly from the base 1. Each mating tongue 2 has two opposite obliquely extending mating surfaces 201.

The housing 3 includes an inner insulator 31 integrally formed with the contacts 4 via an insert-molding process, and an outer insulator 32 applied upon the inner insulator 31 and the corresponding contacts 4. The inner insulator 31 includes two inner insulator units 31*a* and 31*b* symmetrical with each other in the vertical direction. The contacts 4 are arranged with two rows, of which one is integrally formed within the unit 31*a* and the other is within the unit 31*b*. Each contact 4 includes a contacting section 41 exposed upon the mating surface 201, an oblique section 43 extending beyond the base 1, and an intermediate section 42 located between the contacting section 41 and the oblique section 43 and retained in the corresponding unit 31*a*, 31*b*. The unit 31*a* includes three inner mating tongues 311 on which the contacting section 41 is exposed, a bridge 312 linking all the inner mating tongues 311, and an oblique fixing section 313 on which the oblique section 43 is exposed for coupling to a mating conductor of a complementary part (not shown). The unit 31*a*, 31*b* forms positioning post 314 and positioning hole 315 for engagement with each other.

A metallic shielding plate 5 is sandwiched between the units 31*a* and 31*b*, and includes three segments 52 linked by the linking section 51, and an obliquely extending common tail section 53 which extends rearwardly beyond the base 1. Two legs 511 are located at two opposite ends of the shielding plate 5. A plurality of holes 521 are formed in the segment 52 for receiving the corresponding positioning 314.

A pair of metallic shields 6 are applied upon two opposite surfaces of the inner insulator 31, and each shield 6 includes three blades 62 extending forwardly from the elongated base 61, one end of the base 61 forms an abutment section 611 for grounding with the leg 511, and the other end of the base 61 forms a hook 612.

The units 31*a* and 31 commonly sandwich the shielding plate 5 with the positioning post 314 extending through the hole 521 and the corresponding positioning hole 315 so as to form the sub-assembly. The inner insulator 31 includes fixing post 316 extending through the fixing hole 613 of the shield 6. The tail section 53 is exposed outside of the fixing section 313. The abutment section 611 of one shield 6 and the hook 612 of the other shield 6 commonly sandwich the corresponding leg 511 therebetween. An outer insulator 31 is applied upon the inner insulator 31 via another insert-molding process, and includes an outer mating tongue 323 and a mounting section 321 linked with the outer mating tongues 323 and enclosing the corresponding bridge 312. A pair of holes 322 are formed at two opposite end regions of the mounting section 321 corresponding to the hooks 612. The hook 612 is used to reinforce such a end region. An insulative outer cover 10 is further applied upon the inner insulator 31 and the outer insulator 32 so that all the mounting section 321 of the outer insulator 32, the bridge 312 of the inner insulator 31 and the outer cover 10 commonly form the base 1. The base 11 forms an oblique surface 11. The shield 6 is located between the base 1 and the inner insulator 31. The blade 62 of the shield 6 is exposed upon the mating surface 201 in a coplanar manner.

The method of making the electrical connector 100 is as follow:

(1) providing a pair of inner insulator units 31*a*, 31*b* each equipped with a plurality of contacts 4 via an insert-molding process and including three inner mating tongues 311 and bridge integrating 312 those three inner mating tongue 311;

(2) providing a metallic shielding plate 5 sandwiched between the inner insulator units 31*a*, 31*b* so as to form a first stage sub-assembly and including a linking section 51 with three segments 52 extending forwardly from the linking section;

(3) positioning a pair of metallic shields 6 upon two opposite surfaces of the first stage sub-assembly wherein each shield 6 includes an elongated base 61 with three blades 62 extending forwardly therefrom;

(4) applying an outer insulator 32 upon the first stage sub-assembly and the associated pair of shields 6 via another insert-molding process to form a second stage sub-assembly wherein the outer insulator 32 includes three outer mating tongues 323 covering the corresponding inner mating tongue 311 to form the three complete mating tongue 2 each of which has two opposite mating surface 201; and (5) applying an insulative outer cover 10 upon the second stage sub-assembly to form the complete connector set wherein the outer cover 10 cooperates with both the mounting section 321 of the outer insulator 32 and the bridge 312 of the inner insulator 31 to commonly form the base 1.

Notably, the invention provides a method and the corresponding structures to make the signal connector set with three mating tongues with the corresponding metallic shields via a series of insert-molding process wherein the mating tongues are communicatively exposed to one another along the transverse direction for facilitating mating with the complementary connectors and the whole connector set is essentially symmetrical about the vertical centerline so as to perfect the molding effect and the internal stress thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing including a base and a plurality of mating tongues forwardly extending from the base and defining two opposite mating surfaces, said insulative housing being symmetrical with regard to a vertical centerline in a front view;

a plurality of contacts integrally formed within the housing;

the housing essentially composed of a pair of inner insulator units each integrally formed with the corresponding contacts via a first stage insert-molding process and including a bridge with a plurality of inner mating tongues forwardly extending therefrom;

a metallic shielding plates sandwiched between the pair inner insulator units to form a first stage sub-assembly;

a pair of metallic shields disposed upon two opposite surfaces of the first stage sub-assembly; and an outer insulator applying upon the first stage sub-assembly via a second stage insert-molding process to form a second stage sub-assembly, wherein the shield is exposed upon the corresponding mating surface in a coplanar manner and further including an insulative outer cover applied upon the second stage sub-assembly to complete the whole connector, wherein the shielding plate includes a linking section covered by the bridge and a plurality of segments extending from the linking section and covered by the corresponding inner mating tongues, wherein the shield includes an elongated base covering the bridge, and a plurality of blades extending from the elongated base and covering the corresponding mating tongues, wherein the shield includes an abutment section at one end to mechanically and electrically connect to the leg of the shielding plate.

2. The electrical connector as claimed in claim 1, wherein the each of the inner insulator units includes a fixing section obliquely extending rearwardly from the bridge with oblique sections of the contacts are exposed, and the shielding plate further includes an obliquely extending common tail section sandwiched between the fixing sections of the pair of inner insulator units.

3. The electrical connector as claimed in claim 1, wherein the shield includes a hook at one end to reinforce an insulative outer cover applied upon the second stage sub-assembly.

4. The electrical connector as claimed in claim 1, wherein the mating tongues communicate with one another transversely.

5. The electrical connector as claimed in claim 1, wherein the each of the inner insulator units includes a fixing section obliquely extending rearwardly from the bridge with oblique sections of the contacts are exposed.

6. A method of making an electrical connector, comprising steps of:

providing a pair of inner insulator units each integrally formed with corresponding contacts via an insert-molding process and configured with a bridge unitarily formed with a plurality of inner mating tongues;

providing a metallic shielding plate sandwiched between the pair of inner insulator units and including a plurality of segments integrally formed with a transversely extending linking section, wherein the segments are covered by the corresponding inner mating tongues and the linking section is covered by the bridges;

covering the pair of inner insulator units with a pair of metallic shields respectively, each of said shields including an elongated base with a plurality of blades extending therefrom, wherein the elongated base covers the corresponding bridge and said blades cover the corresponding inner mating tongues, respectively; and unifying the pair of inner insulator units, the pair of metallic shields and the shielding plate with an outer insulator via another insert molding process to form a sub-assembly, wherein the pair of metallic shields mechanically and electrically connect to the shielding plate, wherein each of said inner insulator units further includes an oblique fixing section with oblique sections of the contacts thereon to cover an obliquely extending common tail section of the metallic shielding plate, wherein each of the metallic shields includes a hook structure at one end to reinforce a mounting section formed by the outer insulator, wherein the sub-assembly includes an insulative housing essentially composed of a base with a plurality of mating tongues extending forwardly therefrom, wherein said mating tongues communicate with one another along the transverse direction.

7. The method as claimed in claim 6, further including a step of applying an outer cover upon the sub-assembly to cover the pair of metallic shields.

8. A method of making and electrical connector, comprising steps of: providing a pair of inner insulator units each integrally formed with corresponding contacts via an insert-molding process and configured with a bridge unitarily formed with a plurality of inner mating tongues; providing a metallic shielding plate sandwiched between the pair of inner insulator units and including a plurality of segments integrally formed with a transversely extending linking section, wherein the segments are covered by the corresponding inner mating tongues and the linking section is covered by the bridges; covering the pair of inner insulator units with a pair of metallic shields respectively, each of said shields including an elongated base with a plurality of blades extending therefrom, wherein the elongated base covers the corresponding bridge and said blades cover the corresponding inner mating tongues, respectively; and unifying the pair of inner insulator units, the pair of metallic shields and the shielding plate with an outer insulator via another insert molding process to form a sub-assembly, wherein the pair of metallic shields mechanically and electrically connect to the shielding plate, wherein each of the metallic shields includes a hook structure at one end to reinforce a mounting section formed by the outer insulator, wherein the sub-assembly includes an insulative housing essentially composed of a base with a plurality of mating tongues extending forwardly therefrom, wherein said mating tongues communicate with one another along the transverse direction, further including a step of applying an outer cover upon the sub-assembly to cover the pair of metallic shields.

* * * * *